United States Patent [19]

Schiemann

[11] Patent Number: 4,800,620

[45] Date of Patent: Jan. 31, 1989

[54] HINGE CONNECTION

[76] Inventor: Wolfram Schiemann, Eugen-Nagele-Str. 17, D-7140 Ludwigsburg, Fed. Rep. of Germany

[21] Appl. No.: 101,398

[22] Filed: Sep. 28, 1987

[30] Foreign Application Priority Data

Oct. 1, 1986 [DE] Fed. Rep. of Germany ... 8626257[U]

[51] Int. Cl.[4] ..... E05D 1/00; E05D 7/10

[52] U.S. Cl. ..... 16/225; 16/257; 16/254; 16/388; 403/290; 403/297

[58] Field of Search ..... 16/225, 227, 257, 268, 16/383, 387, 388, DIG. 40, 382, 258, 254; 403/290, 297, 9

[56] References Cited

FOREIGN PATENT DOCUMENTS 3200889 1/1983 Fed. Rep. of Germany .... 16/114 R 1063697 3/1967 United Kingdom ..... 16/225

*Primary Examiner*—Nicholas P. Godici

*Assistant Examiner*—Carmine Cuda

[57] ABSTRACT

A hinge connection comprises a one-piece hinge part of synthetic plastic material and a separate part to which the hinge part is fittable. The hinge part comprises an elastic joint film forming a joint axis and stiffening strips extending on both sides thereof parallel to the joint axis and formed by material thickenings. On at least one stiffening strip there are formed two resilient tongues protruding with mutual spacing and in one common plane, on the ends of which tongues there are formed projections pointing away from one another. The separate part comprises an insertion socket into which the tongues can be inserted until the projections engage, in the assembled condition of the hinge connection, behind opposite side wall sections of the insert socket. An elastically flexible crossing piece connects the ends of the tongues.

17 Claims, 2 Drawing Sheets

HINGE CONNECTION

The invention relates to a hinge connection comprising a one-piece hinge part of synthetic plastic material and a separate part to which the hinge part is fittable. The hinge part has an elastic joint film forming a joint axis and stiffening strips extending on both sides thereof parallel to the joint axis and formed by material thickenings. At least one stiffening strip has two resilient tonges spaced from each other and protruding in a common plane, which tongues have ends with projections pointing away from one another. The separate part has spaced, opposed side wall sections and an insertion socket into which the tongues can be inserted until the projections engage behind the opposite side wall sections in the assembled condition of the hinge connection.

BACKGROUND OF THE INVENTION

Such a hinge connection is described in DE-GmS No. 7,918,759. In this case the tongues protrude from the stiffening strip independently of one another.

OBJECT AND STATEMENT OF THE INVENTION

It is the object of the invention to produce a hinge connection of this classification which can be snapped into engagement more reliably and assembled more easily.

This object is achieved by an elastically flexible crossing piece that connects the ends of the tongues.

The crossing piece, when it extends straight in the installed condition, serves as locking bolt for the engaged projections, which thus are fixed extremely reliably in the insertion socket. It is therefore possible to use shorter projections and accordingly the side wall sections of the insertion socket can also be made thinner. Often, in fact, their wall thickness is determined only in that they need to be made so thick that the engaging projections do not protrude beyond the outer surface. While conventional hinges have projections protruding by 1.5 mm. with the consequence of corresponding wall thicknesses, now a projection of 0.5 mm. is sufficient. Smaller projections also have the consequence that the tongues have to be bent inwards less for pushing into the insertion socket. Furthermore, the two tongues can be drawn towards one another by the crossing piece by action at one single point, similarly to a chord of an arc, whereby, for example, mechanical assembly is facilitated.

Further advantages and developments are stated in the following paragraphs and appear from the following description of preferred forms of embodiment of the invention.

The crossing piece is aligned parallel to the joint axis.

Between the tongues the crossing piece is slightly curved towards the joint axis.

The stiffening strip with the tongues protruding therefrom and the crossing piece connecting the tongue ends constitute a somewhat rectangular frame.

The crossing piece is longer than the tongues.

The crossing piece is about four times as long as the tongues.

The crossing piece is about 28 mm. long.

The crossing piece has a cross section approximately equal in width and thickness with the tongues.

The crossing piece has regions of transition to the tongues and a middle region measured in the common plane that is somewhat wider than in the transition regions.

The crossing piece is 2 mm. thick, 2 mm. wide in the transition regions and 2.5 mm. wide in the middle region.

Two triangular support wings are formed on the stiffening strip symmetrically with one another and laterally of the middle of the stiffening strip. Each of the triangle support wings has an apex that points to the region of transition of the crossing piece to a respective one of the tongues and side flanks facing and spaced from a respective one of the tongues and the crossing piece.

The crossing piece has an inner face facing the stiffening strip and the side flanks of the support wings and can be flexed to an elastically fully flexed condition in which the inner face contacts the side flanks of the support wings.

The crossing piece is arranged to flex to contact the support wings, whereby each of the tongues is drawn inwards by at least the amount of overhang of the projections in relation to the tongue.

The overhang of the projections is about 0.5 mm.

A second separate part is provided and the hinge part is made in mirror-symmetry in relation to the joint axis and is fittable in mirror-image manner to articulatedly connect the two separate parts.

The stiffening strips have longitudinal edges that stand up beyond the common plane of the tongues and the crossing piece, and the joint film extends between the longitudinal edges of the stiffening strips.

The tongues and the crossing piece are formed on only one stiffening strip, and a catch part is formed on the opposite stiffening strip in relation to the joint axis.

If the crossing piece does not extend straight and parallel to the joint axis, but is somewhat curved towards the joint axis between the tongues, it acts upon the tongues after the style of a toggle lever and holds the projections securely in engagement. However, the curvature renders it possible to press the projections inwards from the exterior, with the crossing piece springing inwards. Thus, according to need, dismantlement of the hinge is possible, even if the space or installation conditions do not permit one to press in the crossing piece itself in the middle.

In that a somewhat rectangular frame is produced by the crossing piece, the hinge parts, if they are stored as loose bulk goods, cannot hook into one another.

In order to draw the tongues inwards for the purpose of fitting or dismantling the hinge, the crossing piece must be capable of being bent through with its middle region towards the stiffening strip, for which a corresponding free space is to be left between crossing piece and stiffening strip. If, however, space not necessary for this purpose is occupied with support wings (without hindrance to the mobility of the tongues and the crossing piece) thus a higher stability of the stiffening strip is gained thereby. Moreover, the side flanks of the support wings which face the crossing piece can act as wedge sliding faces which favor the drawing-in of the tongues.

DETAILED DESCRIPTION OF PREFERRED EMBODIMENTS

Figure 1:
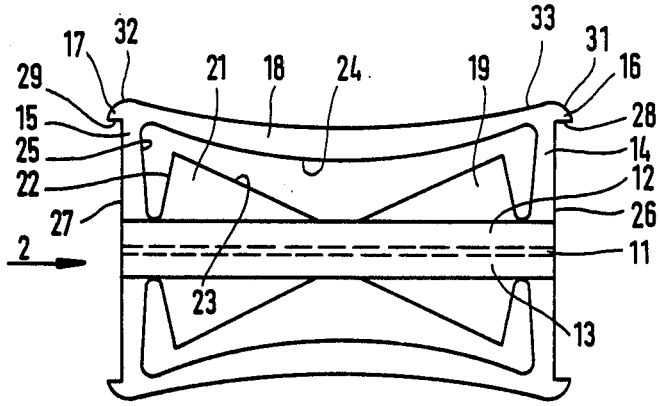
FIG. 1 shows a plan veiw of a hinge part according to the invention.
Figure 2:
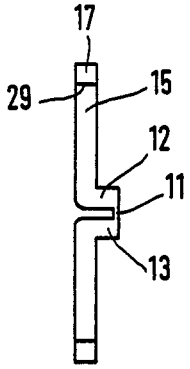
FIG. 2 shows a lateral elevation in the direction of the arrow 2 in FIG. 1.

The hinge part as represented in FIGS. 1 and 2 has an elastic joint film 11 forming a joint axis, which extends over the whole length of the hinge part and is about 0.2 mm. in thickness. It consists of a suitable elastic synthetic plastic material so that the joint film 11 withstands an adequate number of articulation movements. Stiffening strips 12 and 13 formed by material thickenings are formed on to both sides of the joint film 11 at an interval of about 1 mm. In this example of embodiment the hinge part is made symmetrical in relation to the joint axis and the joint film 11, so that the description can be limited to the upper part.

Resilient tongues 14 and 15 each tapering towards the end are formed on both ends of the stiffening strip 12. On their ends there are formed projections 16, 17 pointing away from one another and between the ends there extends a crossing piece 18 in this case slightly bent twards the stiffening strip 12.

Figure 5:
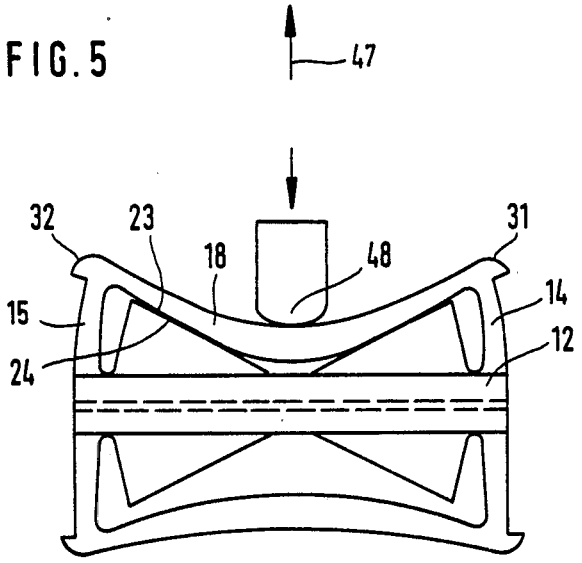
FIG. 5 shows a view corresponding to FIG. 1 with the crossing piece bent.

On the stiffening strip 12 there are further formed two triangular support wings 19, 21 attached symmetrically in relation to one another and laterally of the centre, the side flanks 22, 23 of which wings are adequately spaced from the facing surfaces 24, 25 of tongue 14, 15 and crossing piece 18 not to hinder flexure of the crossing piece 18 and inward bending of the tongues 14, 15 into the position as represented in FIG. 5.

The tongues 14, 15, the support wings 19, 21 and the crossing piece 18 lie in one common plane and are also of equal thickness (in the view in FIG. 2), namely 2 mm. The tongues 14, 15 are about 2.5 mm. wide at the base on the stiffening strip and taper at the level of the projection 16, 17 to a width of 2 mm. The projections 16, 17 prorude by 0.5 mm. beyond the outer faces 26, 27 of the tongues 14, 15, which extend perpendicularly of the stiffening strip 12. The projections 16, 17 each form a catch face 28, 29 protruding approximately perpendicularly from the outer face 26, 27 in each case, from which in each case an approximately semi-circularly curved sliding face 31,32 starts upward, merging into the upper outer face 33 of the crossing piece 18. In the regions of transition into the tongues 14, 15 the crossing piece 18 is 2 mm. in width and thickens to 2.5 mm. in the middle zone. It is understood that the transitions between the faces 24 and 25 and between the face 25 and the side flank 22 are rounded. The sag or flexure of the crossing piece 18 in the relaxed condition according to FIG. 1 amounts to about 1 mm. The crossing piece 18 with the tongues 14, 15 and the stiffening strip 12 form a somewhat rectangular frame, the crossing piece 18 being about 28 mm. in length between the tongues 14, 15 and the tongues extending up about 6 mm. from the stiffening strip to the catch face 28, 29.

As may be seen from FIG. 2, the stiffening strips 12 and 13 protrude by 2 mm. from the common plane of the tongues 14, 15and of the crossing piece 18, and the joint film 11 extends between the longitudinal edges of the stiffening strips lying above the plane.

Figure 3:
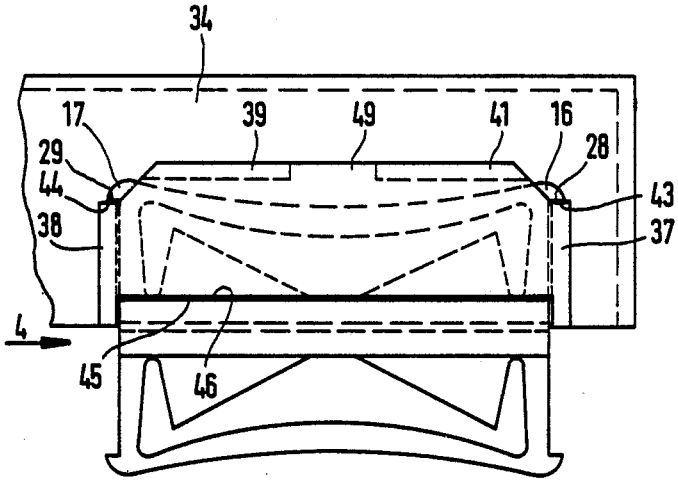
FIG. 3 shows a view corresponding to FIG. 1 with the upper hinge half shown fitted in an insertion socket of a box part.
Figure 4:
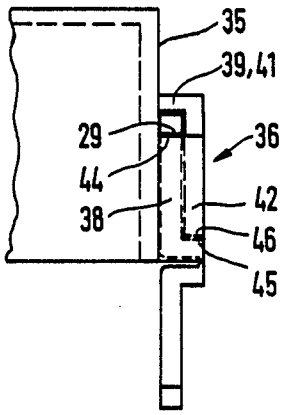
FIG. 4 shows a lateral elevation in the direction of the arrow 4 in FIG. 3.

According to FIGS. 3 and 4 the hinge part as desacribed hitherto is shown secured with its upper half to a separate part 34, for example a box lid. For this purpose, in a manner known per se, the part 34 has on its rear wall 35 an insertion socket 36 which comprises two side wall sections 37, 38, two transverse wall sections 39, 41 and a cover wall 42 lying parallel to and spaced from the rear wall 35, the spacing amounting to 2 mm. Behind the side wall sections 37, 38 the insertion socket 36 is open, so that the projections 16, 17 can snap with their detent faces 28, 29 behind the end faces 43, 44 of the side wall sections 37, 38.

In the fitted condition according to FIGS. 3 and 4 the longitudinal edge 45 of the stiffening strip 12 is supported on the longitudinal edge 46 of the cover wall 42, while in the opposite direction the detent faces 28, 29 lie on the end faces 43, 44. The lateral retention results from the fact that the outer faces 26, 27 of the tongues 14, 15 rest inwardly on the side wall sections 37, 38.

Hinge parts of the kind as described are used for accessory boxes, such as screw assortment boxes, spare bulb boxes for cars or small demonstration cases etc., that is wherever metal hinges or PVC pin/sleeve hinges of conventional style are too expensive. Since the hinge part is separated from the container part, consideration does not need to be given to the different functions, in the selection of materials on both sides. The above-mentioned boxes are mostly specifically mass-produced articles, and for this purpose easy make-up, that is assembly, is very important.

As both tongues 14 and 15 are drawn symmetrically inwards as shown in FIG. 5 by pressing-in of the crossing piece 18 at the same time, almost with one action, the hinge part can be introduced into the corresponding insertion socket 36 in a simple rectilinear movement, for example in the direction of the arrow 47. On account of the simplicity of the movements it is here especially possible to have this assembly effected by a robot. As indicated the latter, apart from grippers not especially illustrated for the sake of better clarity, comprises a ram 48 which bends the crossing piece 18 through towards the stiffening strip 12. As soon as the face 24 of the crossing piece 18 lies on the side flanks 23 of the support wings 19, 21, the outer parts of the crossing piece 18 slide inwards on these inclined side flanks 23, so that the inward drawing of the tongues 14, 15 thus takes place more effectively.

The opening 49 between the transverse wall sections 39, 41 of the insertion socket 36 is capable of facilitating the action of such a ram 48 in assembly. However this opening 49 also proves favourable for the purpose of dismantlment. Admittedly dismantlement as for the purpose of replacement of a defective hinge part comes into question more rarely, but even this operation is substantially facilitated by minimal expense, specifically by the provision of the opening 49. By pressure with a simple ram through the opening 49 upon the crossing piece 18, the projections 16, 17 snap free from the side wall sections 37, 38 and at the same time the hinge part is pressed out of the insertion socket.

It is understood that the lower half of the hinge part according to FIG. 3 is inserted into a similar insertion socket of a further part completing the box.

Figure 6:
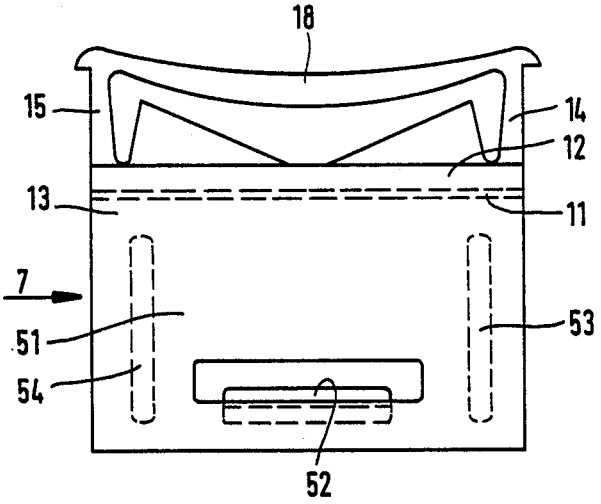
FIG. 6 shows a plan view of a hinge part with formed-on catch part on an enlarged scale.
Figure 7:
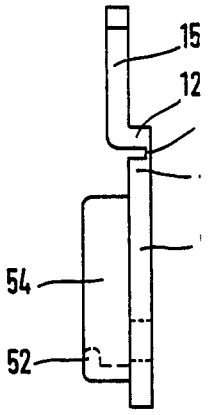
FIG. 7 shows a lateral view in the direction of the arrow 7 in FIG. 6.

In the example of embodiment according to FIGS. 6 and 7 the upper hinge part is made just as in the previous example. However the lower stiffening strip 13 continues as a plate 51 which is formed in known manner as a catch pat. For this purpose it carries a hooked strip 52 and possibly two lateral stiffening ribs 53, 54. This case is conerned with a hinge connection for example of a box lid with the catch part, the fitting of the hinge part on the box lid taking place in the same simple manner as that of the hinge parts on the rear of the box.

In departure from the examples of embodiment as illustrated, the crossing piece 18 can also extend straight between the tongues 14, 15. In this case dismantlement is possible only by pressing-in of the crossing piece 18, because the straight crossing piece 18 acts like a bolt and cannot be caused to yield solely by lateral pressure against the projections 16, 17.

As FIG. 3 shows, the wall thickness of the side wall sections 37, 38 is made so stout that the projections 16, 17 do not protrude beyond their outer side, because this would result in unpleasant possibilities of snagging cleaning cloths etc. Since as a result of the strong detent force due to the crossing piece 18 (whether slightly curved or straight) slightly protruding projections 16, 17 are sufficient, the insertion socket 36 can likewise be made thinner. This can be important above all for the achievement of a better appearance of boxes.

I claim:

1. Hinge connection comprising a one-piece hinge part of synthetic plastic material and a separate part to which the hinge part is fittable, said hinge part comprising:

an elastic joint film forming a joint axis and stiffening strips extending on both sides thereof parallel to said joint axis and formed by material thickenings, at least one stiffening strip having two resilient tongues spaced from each other and protruding in a common plane, said tongues having ends with projections pointing away from one another, said separate part comprising:

spaced, opposed side wall sections and an insertion socket into which said tongues can be inserted until said projections engage behind said opposite side wall sections in the assembled condition of said hinge connection, characterized in that an elastically flexible crossing piece connects said end of said tongues.

2. Hinge connection according to claim 1, characterized in that said tongues and said crossing piece are formed on only one stiffening strip, and a catch part is formed on the opposite stiffening strip in relation to said joint axis.

3. Hinge connection according to claim 1, characterized by a second separate part and in that said hinge part is made in mirror-symmetry in relation to said joint axis and is fittable in mirror-image manner to articulatedly connect said two separate parts.

4. Hinge connection according to claim 3, characterized in that said stiffening strips have longitudinal edges that stand up beyond said common plane of said tongues and said crossing piece, and said joint film extends between said longitudinal edges of the stiffening strips.

5. Hinge connection according to claim 1, characterized in that said crossing piece has a cross section approximately equal in width and thickness with said tongues.

6. Hinge connection according to claim 5, characterized in that said crossing piece has regions of transition to said tongues and a middle region measured in said common plane that is somewhat wider than in said transition regions.

7. Hinge connection according to claim 6, characterized in that said crossing piece is 2 mm. thick, 2 mm. wide in said transition regions and 2.5 mm. wide in said middle region.

8. Hinge connection according to claim 1, characterized in that said crossing piece is aligned parallel to said joint axis.

9. Hinge connection accordinag to claim 8, characterized in that between said tongues said crossing piece is slightly curved towards said joint axis.

10. Hinge connection according to claim 8, characterized in that said stiffening strip with said tongues protruding therefrom and said crossing piece connecting said tongue ends constitute a somewhat rectangular frame.

11. Hinge connection according to claim 10, characterized in that said crossing piece is longer than said tongues.

12. Hinge connection according to claim 11, characterized in that said crossing piece is about four times as long as said tongues.

13. Hinge connection according to claim 12, characterized in that said crossing piece is about 28 mm. long.

14. Hinge connection according to claim 10, characterized in that two triangular support wings are formed on said stiffening strip symmetrically with one another and laterally of the middle of said stiffening strip, each of said triangle support wings having an apex that points to the region of transition of said crossing piece to a respective one of said tongues and side flanks facing and spaced from a respective one of said tongues and said crossing piece.

15. Hinge connection according to claim 14, characterized in that said crossing piece has an inner face facing said stiffening strip and said side flanks of said support wings and can be flexed to an elastically fully flexed condition in which said inner face contacts said side flanks of said support wings.

16. Hinge connection according to claim 15, characterized in that said crossing piece is arranged to flex to contact said support wings, whereby each of said tongues is drawn inwards by at least the amount of overhang of said projections in relation to said tongue.

17. Hinge connection according to claim 16, characterized in that said overhang of said projections is about 0.5 mm.

* * * * *